US007427256B2

(12) United States Patent
Fan

(10) Patent No.: US 7,427,256 B2
(45) Date of Patent: Sep. 23, 2008

(54) OSCILLATED FITNESS BICYCLE STRUCTURE

(75) Inventor: Jeeng-Neng Fan, Taoyuan (TW)

(73) Assignee: Hsin Lung Accessories Co., Ltd., Taoyuan (TW)

( * ) Notice: Subject to any disclaimer, the term of this patent is extended or adjusted under 35 U.S.C. 154(b) by 75 days.

(21) Appl. No.: 11/705,102

(22) Filed: Feb. 12, 2007

(65) Prior Publication Data

US 2007/0238586 A1 Oct. 11, 2007

(30) Foreign Application Priority Data

Apr. 7, 2006 (TW) ..... 95205809 U

(51) Int. Cl.
*A63B 22/06* (2006.01)

(52) U.S. Cl. ..... 482/64; 482/95

(58) Field of Classification Search ..... 482/57, 482/63–64, 72, 77, 94–96, 110, 123, 133, 482/135, 136; 472/95–97
See application file for complete search history.

(56) References Cited

U.S. PATENT DOCUMENTS 4,586,706 A * 5/1986 Chen ..... 482/62
5,156,650 A * 10/1992 Bals ..... 482/57
5,453,066 A * 9/1995 Richter, Jr. ..... 482/96
5,549,527 A * 8/1996 Yu ..... 482/57

* cited by examiner

*Primary Examiner*—Fenn C. Mathew
*Assistant Examiner*—Andrew M Tecco
(74) *Attorney, Agent, or Firm*—Rosenberg, Klein & Lee

(57) ABSTRACT

An oscillated fitness bicycle structure includes a first driving apparatus and a second driving apparatus installed on a base, an eccentric portion on the first driving apparatus, a driving rod integrated to a handle support rod and disposed on a saddle support rod, a back-and-forth oscillation rod connected to the handle support rod and saddle support rod, and a resilient element for providing upward bounces anytime. When an exerciser sits on the saddle, the body weight of the exerciser pushes the saddle support rod downward and two driving rods drive a driving wheel of the first driving apparatus and a weight wheel of the second driving apparatus to rotate, such that the handle support rod and saddle support rod can perform leaping back-and-forth, up-and-down and sideway oscillations to provide an exercise similar to a horse riding exercise.

5 Claims, 9 Drawing Sheets

OSCILLATED FITNESS BICYCLE STRUCTURE

BACKGROUND OF THE INVENTION

1. Field of the Invention

The present invention relates to an oscillated fitness bicycle structure, and more particularly to a simple-to-install and convenient-to-operate fitness bicycle that provides a more diversified, extended, interesting and variable bicycle structure capable of meeting the actual requirements of an oscillated fitness bicycle.

2. Description of the Related Art

In general, the assembly and operation of a traditional indoor fitness bicycle provides an exerciser a pedaling exercise for both legs, and the exercise is very similar to riding a bicycle that provides exercises for both legs. Since the fitness bicycle may come with a resistance adjusting device for adjusting the level of friction, so that the exerciser can adjust the friction to an appropriate level in order to achieve the desired exercising purpose and effect for the exerciser's legs. Undeniably, the operation of this kind of fitness bicycles can achieve the expected effects and purposes. However, we also know that the operating method and exercise form of simply providing exercises for both legs may be monotonic and boring to the exerciser, which may reduce the expected exercise effects.

In view of the foregoing shortcomings of the prior art, the inventor of the present invention based on years of experience in the related field conducted extensive researches and experiments, and finally invented an oscillated fitness bicycle structure in accordance with the present invention.

SUMMARY OF THE INVENTION

The primary objective of the present invention is to overcome the shortcomings of the prior art by providing an oscillated fitness bicycle structure, wherein the front ends integrated with a handle support rod and a saddle support rod are pivotally coupled to a base by an oscillation rod, and both sides of the rear ends are installed at eccentric portions on both ends of a shaft of a first driving apparatus by a driving rod and bounced upward by a resilient element, and thus the first driving apparatus and second driving apparatus can maintain a synchronous rotation. If an exerciser sits on a saddle, the exerciser's body weight will drive the rear ends of the handle support rod and the saddle support rod to move downward. In the meantime, the two driving rods drive a driving wheel of the first driving apparatus and a weight wheel of the second driving apparatus to rotate, and the weight wheel of the second driving apparatus further drives the driving wheel of the first driving apparatus to rotate by an inertia force during its rotations, and the two driving rods push the rear ends of the handle support rod and the saddle support rod upward by an eccentric circumferential movement. The force produced by the exerciser's hip, waist, hands or legs is applied to the handle support rod and the saddle support rod, and thus the handle support rod and the saddle support rod naturally perform leaping back-and-forth and up-and-down oscillations, so as to provide an exercise similar to a horse riding exercise as well as a more diversified, extended, interesting and variable bicycle structure for the operation of a fitness bicycle and achieve the expected objectives and effects.

Another objective of the present invention is to provide an oscillated fitness bicycle structure, wherein the two driving rods are installed at different positions of the eccentric portions on both ends of the shaft of the first driving apparatus, such that when the handle support rod and the saddle support rod perform back-and-forth and up-and-down oscillations, sideway oscillations are also performed synchronously to provide an exercise with a lifelike effect similar to a horse riding exercise.

A further objective of the present invention is to provide an oscillated fitness bicycle structure, such that after the weight wheel of the second driving apparatus is driven to rotate by the first driving apparatus, an inertia force drives the shaft of the first driving apparatus to rotate, and thus the two driving rods are driven to rotate, and the swing of the saddle support rod and the handle support rod will not be discontinued due to the weight of the exerciser being exerted on the saddle to provide a smooth operating, coordinating and comfortable effect for an exercise similar to a horse riding exercise.

To make it easy for our examiner to understand the objectives, characteristics and effects of the present invention, a preferred embodiment together with the attached drawings will be described.

DETAILED DESCRIPTION OF THE PREFERRED EMBODIMENTS

The above and other objects, features and advantages of the present invention will become apparent from the following detailed description taken with the accompanying drawings.

Figure 1:
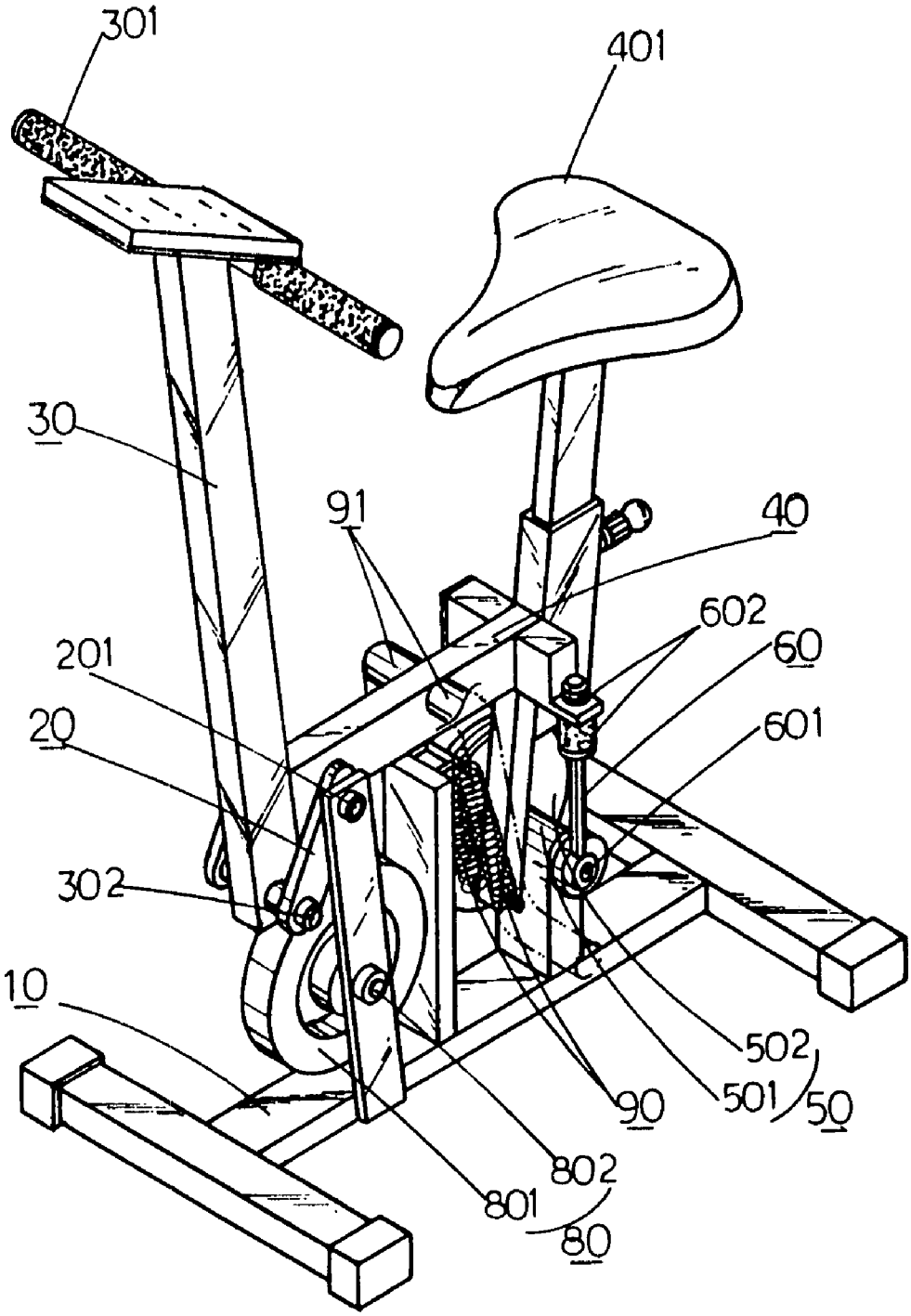
FIG. 1 is a perspective view of the present invention.
Figure 2:
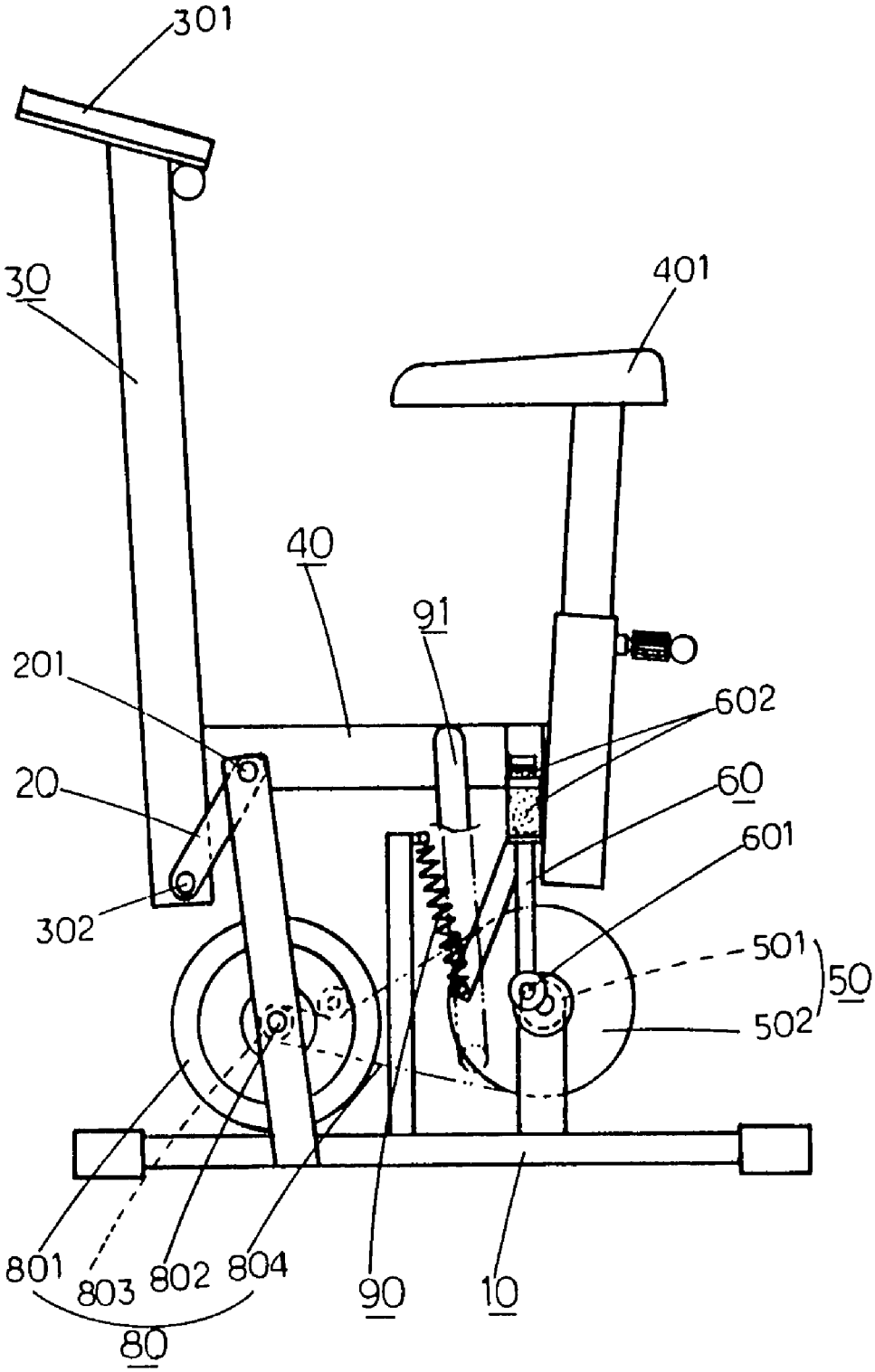
FIG. 2 is a front view of FIG. 1.
Figure 3:
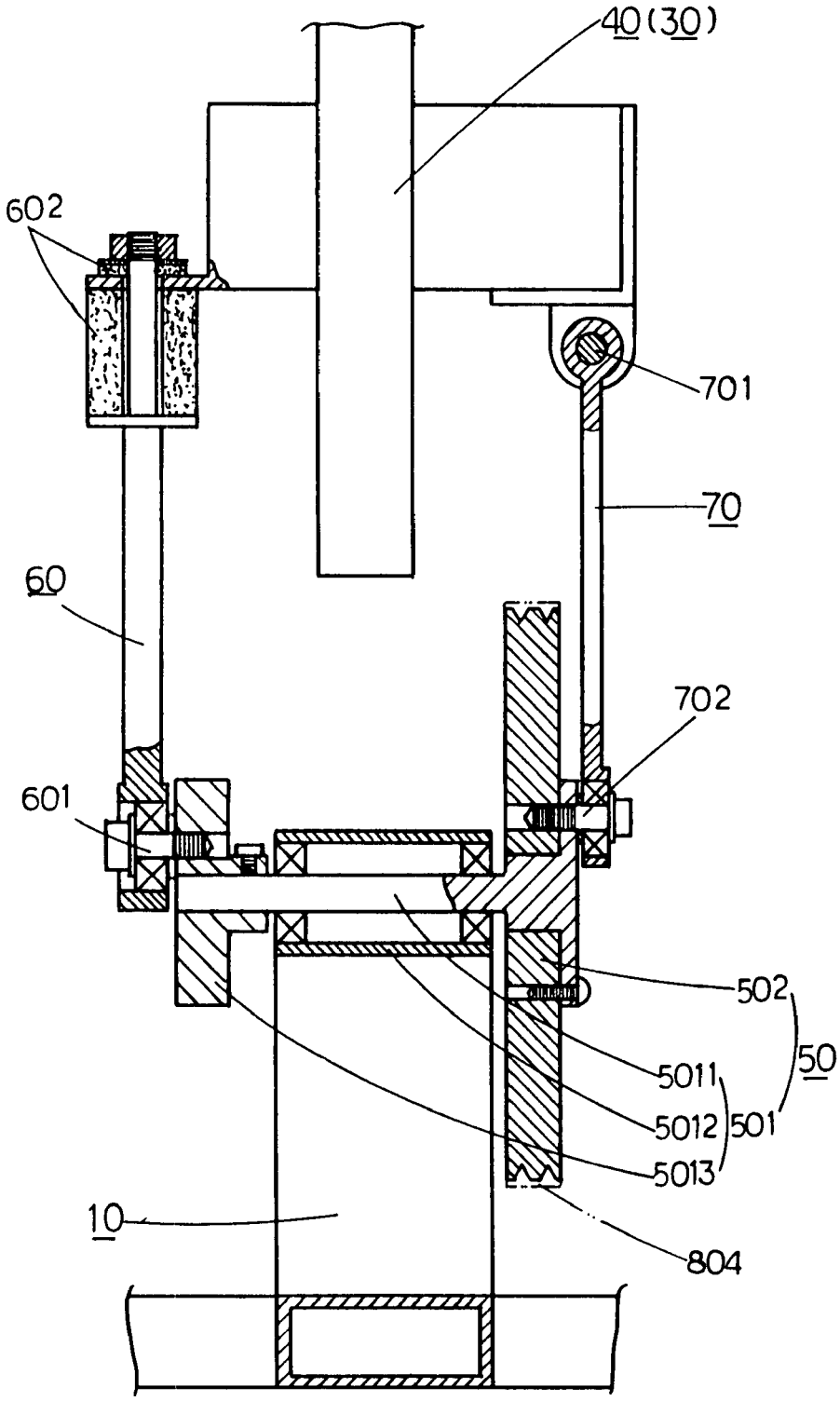
FIG. 3 is a schematic side view of a first driving apparatus, two driving rods, a saddle support rod and a base connected with each other in accordance with the present invention.
Figure 4:
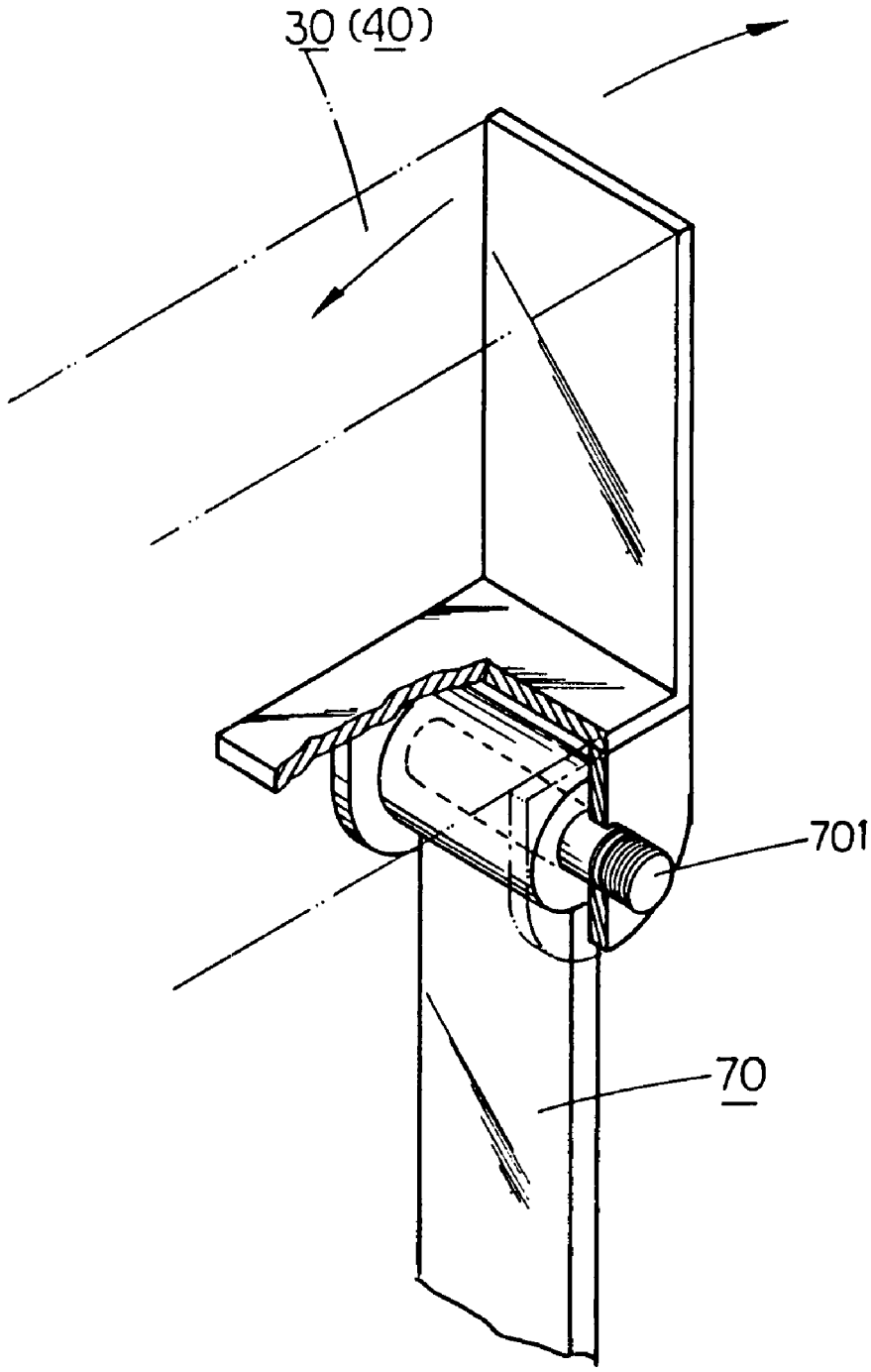
FIG. 4 is a perspective view of a second driving rod and a saddle support rod connected with each other in accordance with the present invention.
Figure 7:
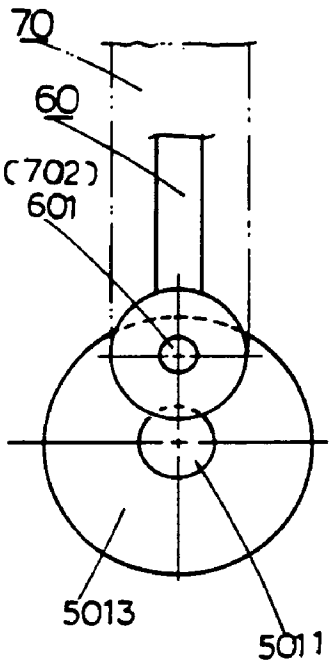
FIG. 7 is a schematic view of a first driving rod and a second driving rod at same eccentric positions, angles and distances in accordance with a preferred embodiment of the present invention.
Figure 6:
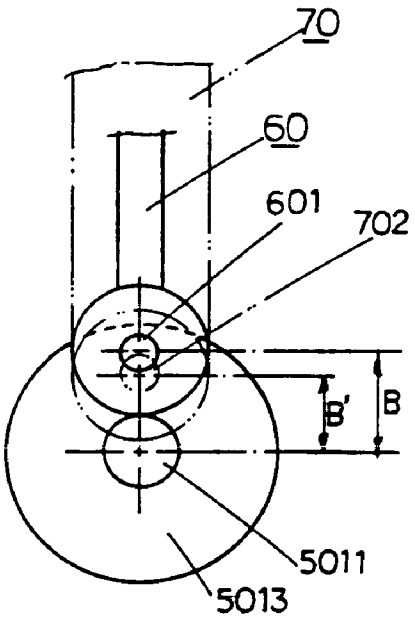
FIG. 6 is a schematic view of a first driving rod and a second driving rod at different eccentric distances in accordance with a preferred embodiment of the present invention.
Figure 5:
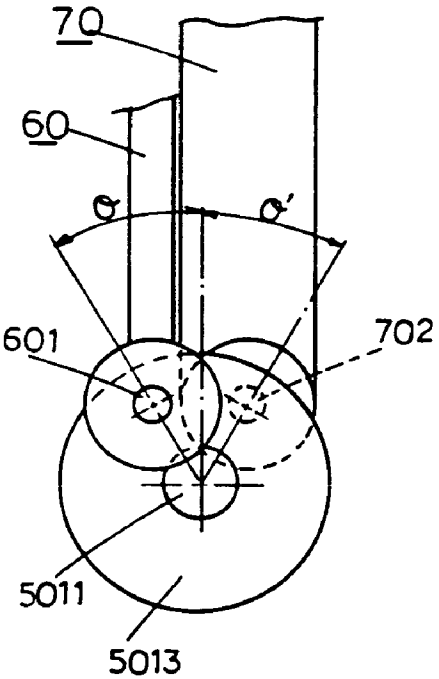
FIG. 5 is a schematic view of a first driving rod and a second driving rod at different eccentric positions and angles in accordance with a preferred embodiment of the present invention.

Referring to FIGS. 1 to 2, an oscillated fitness bicycle structure in accordance with the present invention comprises:

a base 10, for installing the following components;

an oscillation rod 20, with an end pivotally coupled to a front end of the base 10 by an axle pin 201, for performing back-and-forth oscillations;

a handle support rod 30 and a saddle support rod 40, integrated with each other and having a handle 301 disposed at a front end of the top, an axle pin 302 pivotally coupled to another end of the oscillation rod 20, and a saddle 401 disposed at a rear end of the top;

a first driving apparatus 50 as shown in FIG. 3, having a shaft module 501 with a shaft 5011 fixed to a rear end of the base 10 by an axle base 5012 and a driving wheel 502 installed at an end of the shaft 5011 of the shaft module 501;

a first driving rod 60 as shown in FIG. 3, with an end vertically and integrally coupled to a side of rear ends of the handle support rod 30 and the saddle support rod 40 and another end freely and rotably fixed to the eccentric portion at an end of the shaft 5011 of the first driving apparatus 50 by a positioning bolt 601 (wherein an embodiment of the invention includes a positioning disc 5013 mounted onto an end of the shaft 5011 and disposed at an eccentric position for fixing the first driving rod 60), and can rotate with the shaft 5011 to push or pull a side at the rear ends of the handle support rod 30 and the saddle support rod 40, wherein a shock absorbing element 602 (such as a resilient element or a polyurethane shock absorbing element) is installed at the connecting position of rear ends of the handle support rod 30 and the saddle support rod 40;

a second driving rod 70 as shown in FIGS. 3 and 4, having an end pivotally coupled to another side at rear ends of the handle support rod 30 and the saddle support rod 40 in a sideway oscillating manner by a positioning bolt 701, and another end freely and rotably fixed to an eccentric portion at another end of a shaft 5011 of the first driving apparatus by a positioning bolt 702 for pushing or pulling another side of the rear ends of the handle support rod 30 and the saddle support rod 40 as the shaft 5011 rotates. Referring to FIGS. 5, 6 and 7, the second driving rod 70 and the first driving rod 60 can be installed at the same positions of the eccentric portions on both ends of the first driving apparatus 50 (such as different eccentric angles θ, θ' as shown in FIG. 5 or installed at different eccentric distances B, B' as shown in FIG. 6, or installed at same eccentric angles and distances as shown in FIG. 7);

a second driving apparatus 80, having a weight wheel 801 with an appropriate weight and freely and rotably installed at the base 10 by a shaft 802; a driving wheel 803 installed coaxially with the weight wheel 801 on the shaft 802; a driving belt 804 surrounded between the driving wheel 803 and the driving wheel 502 of the first driving apparatus 50, such that the driving wheel 502 and the weight wheel 801 maintain a link, wherein the diameter of the driving wheel 803 is much smaller than the diameter of the driving wheel 502 of the first driving apparatus 50, and thus the two produce a very large ratio of speeds, and the weight wheel 801 also produces a very large ratio of speeds;

a resilient element 90, installed between the handle support rod 30 with the saddle support rod 40 and the base 10 for providing a bounce for the rear ends of the handle support rod 30 and the saddle support rod 40 anytime; and a pedal rod 91, installed to both sides of the saddle support rod 40 for both legs of an exerciser to pedal.

Figure 8:
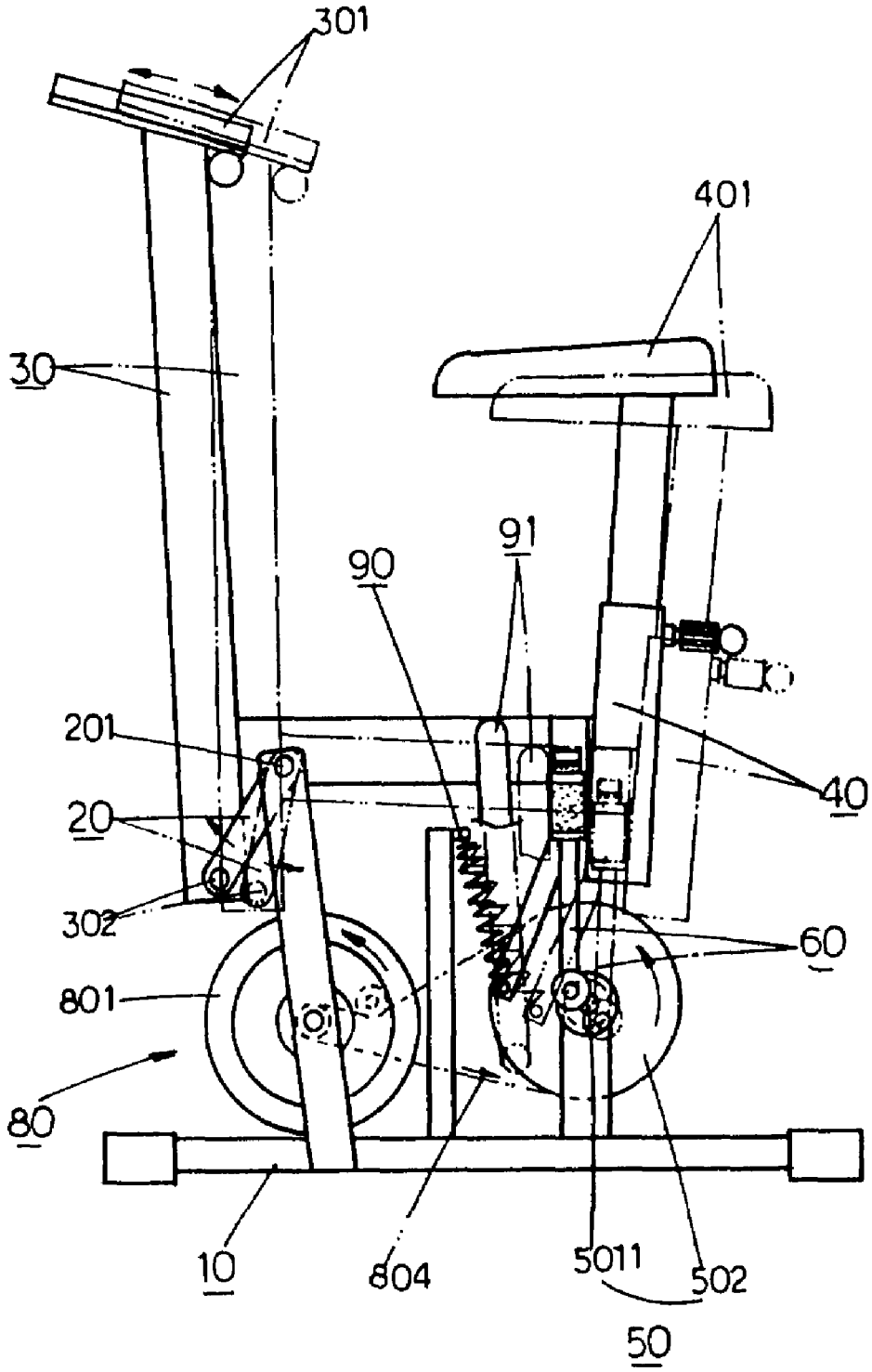
FIG. 8 is a schematic view of an operating status as depicted in FIG. 2.
Figure 9:
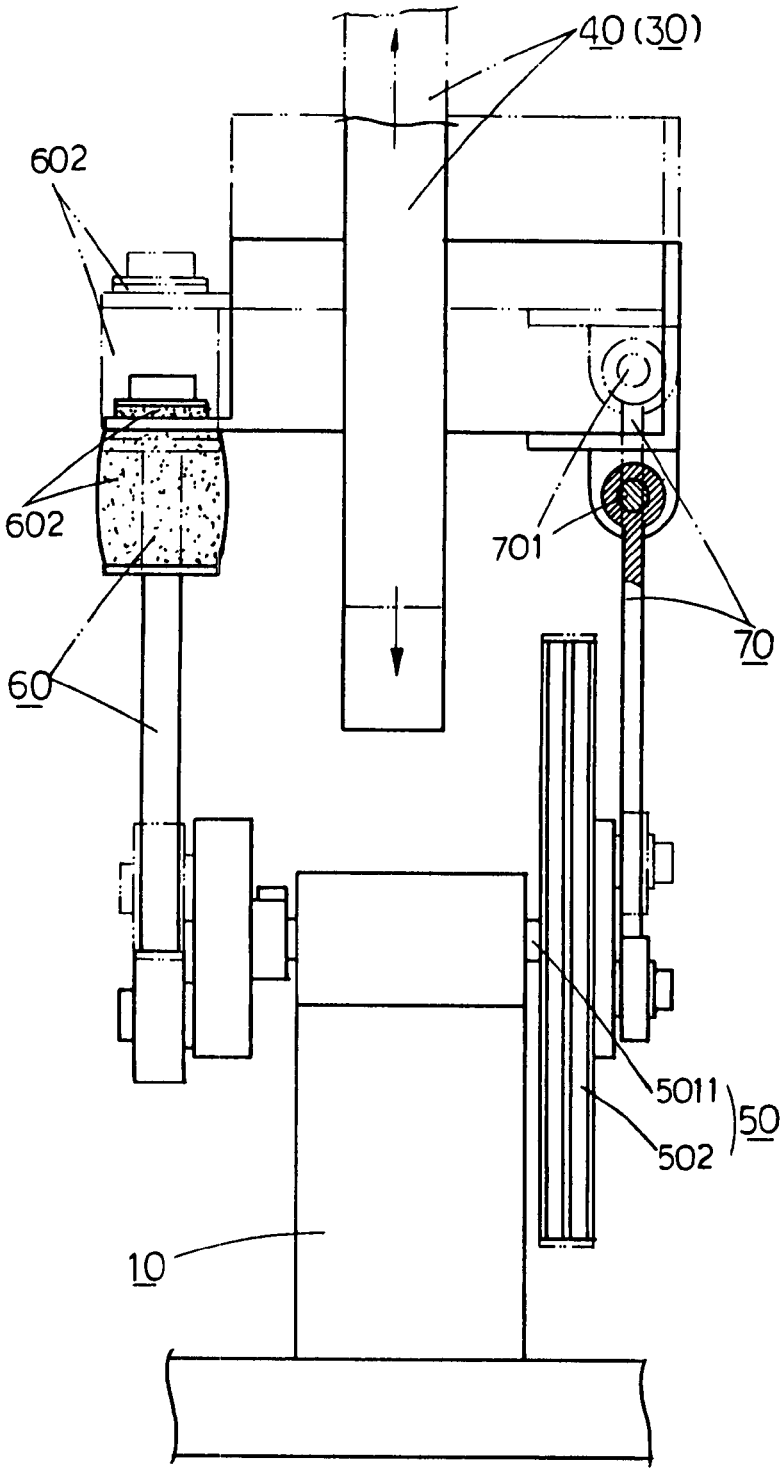
FIG. 9 is a schematic view of a handle support rod and a rear end of a saddle support rod being pulled downward and vertically to the ground by two driving rods in accordance with a preferred embodiment of the present invention.
Figure 10:
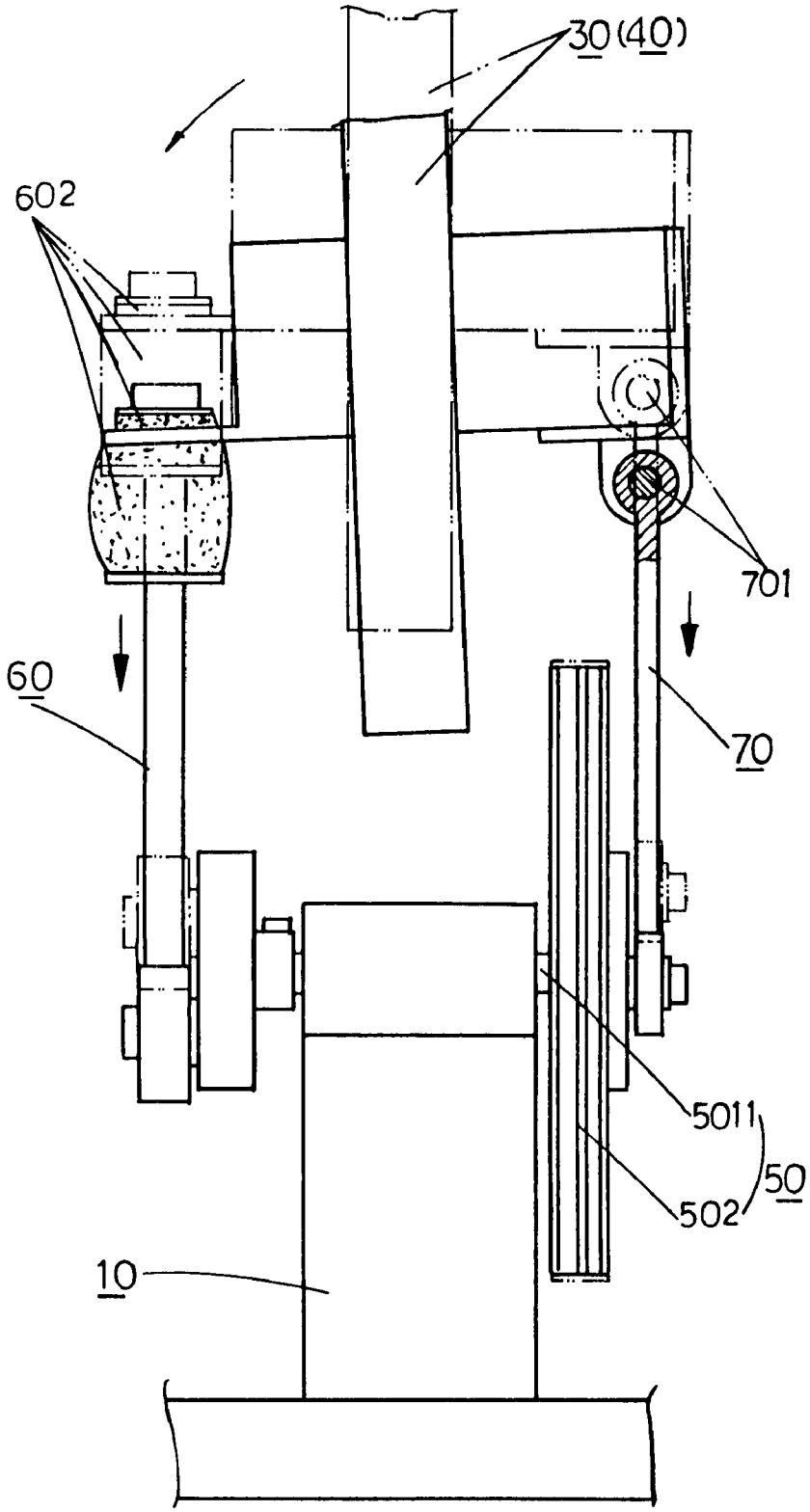
FIG. 10 is a schematic view of rear ends of a handle support rod and a saddle support rod being driven by two driving rods (either pulled downward or pushed upward) and swung to the left side in accordance with a preferred embodiment of the present invention.
Figure 11:
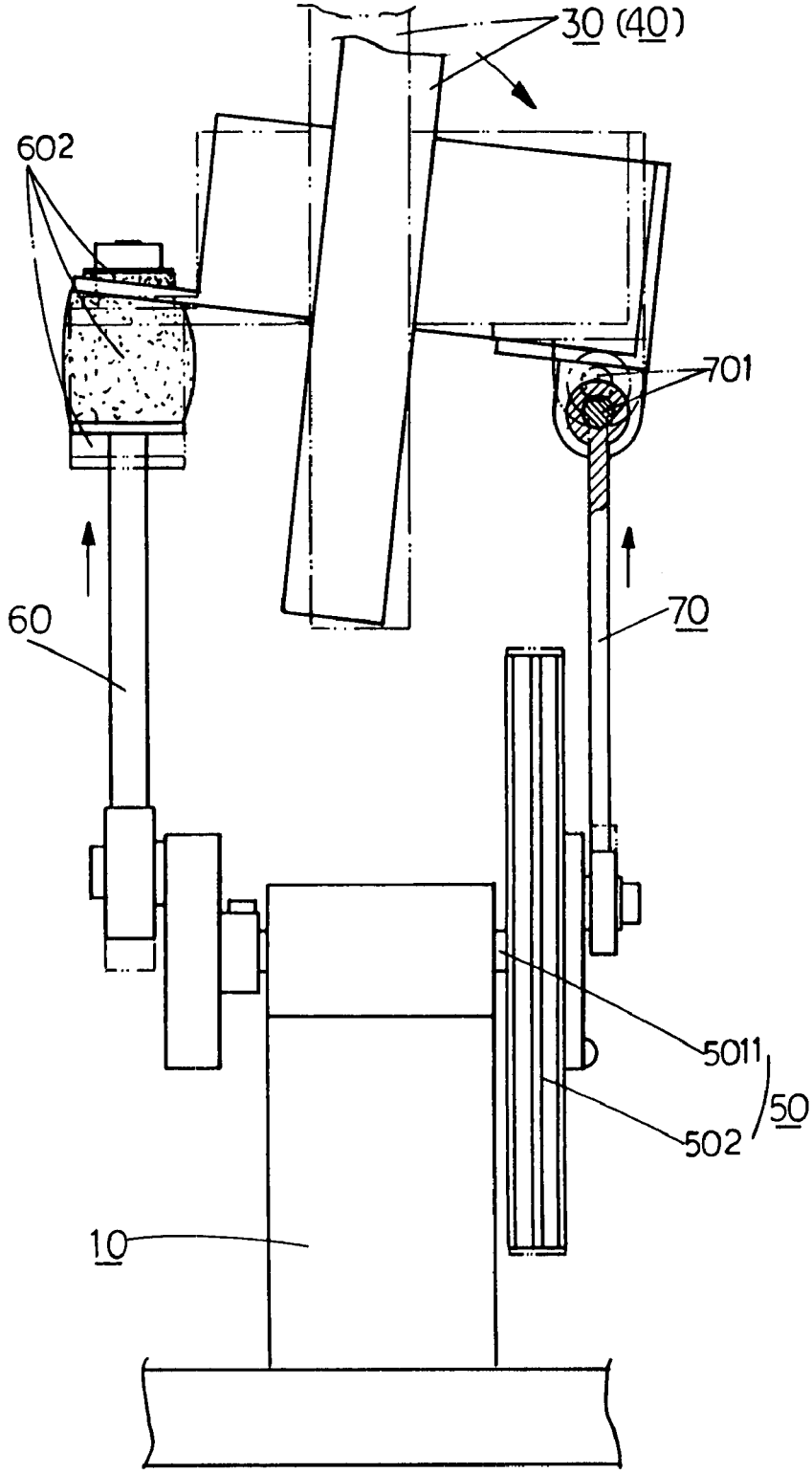
FIG. 11 is a schematic view of rear ends of a handle support rod and a rear end of a saddle support rod being driven by two driving rods (either pulled downward or pushed upward) and swung to the right side in accordance with a preferred embodiment of the present invention.

Referring to FIGS. 8 and 9, the rear ends of the handle support rod 30 and the saddle support rod 40 are coupled to the eccentric portions disposed on both ends of the shaft 5011 of the first driving apparatus 50 by two driving rods 60, 70, and oscillated to its highest position by the resilient element 90, and the front ends are coupled to the base 10 by the back-and-forth oscillating oscillation rod 20, such that when an exerciser sits on the saddle 401 and places both legs on the pedal rod 91, the exerciser's body weight drives the rear ends of the handle support rod 30 and the saddle support rod 40 to descent, and the driving rods 60, 70 push the shaft 5011 of the first driving apparatus 50 to rotate based on the locus of the eccentric position. In the meantime, the front ends of the handle support rod 30 and the saddle support rod 40 base on an axle pin 201 of the oscillation rod 20 to push the oscillation rod 20 to oscillate accordingly. Since the driving wheel 502 installed at the shaft 5011 of the first driving apparatus 50 can drive the weight wheel 801 of the second driving apparatus 80 to rotate synchronously through the driving belt 804 during a rotation, and the weight wheel 801 has a heavy weight and the driving wheel 502 of the first driving apparatus 50 has a larger ratio of speeds (wherein the rotary speed of the weight wheel 801 is faster than that of the driving wheel 502), therefore the weight wheel 801 of the second driving apparatus 80 will rotate in a high speed to produce a very large inertia force, and the inertia force will be transmitted to the driving wheel 502 of the first driving apparatus 50 through the driving belt 804, so as to provide an assisting rotary force for the shaft 5011, when the handle support rod 30 and the saddle support rod 40 ascend to rotate the shaft 5011 of the first driving apparatus 50.

If the exerciser's body weight drives the rear ends of the handle support rod 30 and the saddle support rod 40 to ascend, the exerciser simply needs to apply a force produced by the exerciser's hip, waist, legs and hands onto the handle support rod 30 and the saddle support rod 40 (such as a force applied to the saddle 401, pedal rod 91 or handle 301), so that the shaft 5011 of the first driving apparatus 50 receives a larger driving force and produces a larger inertia force, and the weight wheel 801 of the second driving apparatus 80 can provide a larger inertia force to the driving wheel 502 and the shaft 5011 of the first driving apparatus 50, and the resilient element 90 can provide a bounce anytime at the rear ends of the handle support rod 30 and the saddle support rod 40. The driving rods 60, 70 at the eccentric positions on both ends of the shaft 5011 of the first driving apparatus 50 can perform a quick and smooth circumferential movement and drive the rear ends of the handle support rod 30 and the saddle support rod 40 upward, so that the front ends can be oscillated. With the continuous circulated operation, the handle support rod 30 and the saddle support rod 40 can perform leaping back-and-forth and up-and-down oscillations, and the exerciser sitting on the saddle 401 can do exercises similar to a horse riding exercise. The invention not only achieves the expected exercise effect, but also provides a more diversified, variable and interesting effect for the operation of the fitness bicycle.

Referring to FIGS. 5, 6, 10 and 11, since the first driving rod 60 and the second driving rod 70 are fixed respectively to different eccentric positions on both ends of the shaft 5011 of the first driving apparatus 50, and the second driving rod 70 is pivotally coupled to a side at the rear ends of the handle support rod 30 and the saddle support rod 40 by a positioning bolt 702, so that the handle support rod 30 and the saddle support rod 40 can be oscillated sideway. If the handle support rod 30 and the saddle support rod 40 are driven to perform leaping back-and-forth and up-and-down oscillations, the handle support rod 30 and the saddle support rod 40 will be driven to perform sideway oscillations. Since the first driving rod 60 and the second driving rod 70 are fixed at different eccentric positions on both ends of the shaft 5011, both sides at the rear ends of the handle support rod 30 and the saddle support rod 40 are pushed or pulled by asymmetric heights and positions as the shaft 5011 rotates, and the handle support rod 30 and the saddle support rod 40 are pivotally coupled to the second driving rod 70 in a sideway oscillating manner as the shaft 5011 rotates. In the meantime, both sides of the rear ends of the handle support rod 30 and the saddle support rod 40 are pushed or pulled by two driving rods 60, 70 at different heights and positions, and thus the sideway oscillations will be produced naturally and automatically. Therefore, the handle support rod 30 and the saddle support rod 40 can perform leaping back-and-forth and up-and-down oscillations while performing sideway oscillations, and exercisers can do exercises similar to a horse riding exercise, and the exercisers can operate a more interesting and variable fitness bicycle to achieve the expected exercise and fitness objectives and effects.

Referring to FIG. 7, since the first driving rod 60 and the second driving rod 70 are installed respectively at same eccentric positions on both ends of the shaft 5001, the handle support rod 30 and the saddle support rod 40 can perform leaping back-and-forth and up-and-down oscillations without performing sideway oscillations.

Since a shock absorbing element 602 is installed at the connecting position of the first driving rod 60 with the rear ends of the handle support rod 30 and the saddle support rod 40, such that the handle support rod 30 and the saddle support rod 40 are pushed and pulled by the first driving rod 60 to obtain shock absorptions, so as to provide a more comfortable and harmonic operating effect of an exercisers sitting on the saddle 401.

In summation of the description above, the oscillated fitness bicycle structure of the present invention provides a better effect over traditional indoors fitness bicycles which complies with the patent application requirements, and thus is duly filed for a patent application.

While the invention has been described by means of specific embodiments, numerous modifications and variations could be made thereto by those skilled in the art without departing from the scope and spirit of the invention set forth in the claims.

What is claimed is:

1. An oscillated fitness bicycle structure, comprising:

a base, for installing the following components; and a handle support rod and a saddle support rod, integrally coupled with each other, and having a handle disposed at a front end and a saddle disposed at a rear end;

characterized in that said structure further comprises:

an oscillation rod, with an end pivotally coupled to a front end of said base by an axle pin for back-and-forth switching movements, and another end pivotally coupled with said handle support rod and the bottom of said saddle support rod integrated with each other by an axle pin;

a first driving apparatus, having a shaft module with a shaft fixed at a rear end of said base by an axle base and a driving wheel installed at an end of said shaft of said shaft module;

a first driving rod, with an end vertically and pivotally integrated with said handle support rod and along a side of the rear end of said saddle support rod, and another end rotably fixed at an eccentric portion at an end of a said shaft of said shaft module of said first driving apparatus by a positioning bolt for pushing or pulling said handle support rod and the rear end of said saddle support rod as said shaft rotates;

a second driving rod, with an end pivotally coupled sideways with said handle support rod and another side of a rear end of said saddle support rod, and another end freely and rotably fixed at an eccentric portion at another end of said shaft of said first driving apparatus by a positioning bolt, for pushing or pulling said handle support rod and along another side of the rear of said saddle support rod as said shaft rotates;

a second driving apparatus, having a weight wheel, freely and rotably installed at said base, a driving wheel installed with said weight wheel together at a same shaft, a driving belt surrounded between said driving wheel of said second driving apparatus and said driving wheel of said first driving apparatus, so as to link said weight wheel and said driving wheel of said first driving apparatus;

a resilient element, installed between said handle support rod and said saddle support rod with said base, for providing said handle support rod and the rear end of said saddle support rod with an upward bouncing effect; and a pedal rod, installed on both sides of said saddle support rod for both legs to pedal said pedal rod;

thereby, after an exerciser sits on said saddle and places both legs on said pedal rod, the body weight of said exerciser together with the forces produced by said exerciser's hip, waist, hands or legs are applied onto said handle support rod and said saddle support rod, such that said two driving rods operate together with said weight wheel of said second driving apparatus to transmit a driving force to said shaft of said first driving apparatus, and said two driving rods respectively push and pull said handle support rod and both sides of said saddle support rod during an eccentric circumferential movement, so that said handle support rod and said saddle support rod can perform leaping back-and forth, up-and-down, and sideways oscillations.

2. The oscillated fitness bicycle structure of claim 1, further comprising a shock absorbing element disposed separately at the connecting positions of said first driving rod with said handle support rod and the rear end of said saddle support rod.

3. The oscillated fitness bicycle structure of claim 1, wherein said first and second driving rods are disposed at different positions of eccentric portions on both sides of said shaft of said first driving apparatus, such that said handle support rod and said saddle support rod can perform leaping back-and-forth, up-and-down and left-and-right oscillations.

4. The oscillated fitness bicycle structure of claim 1, wherein said first and second driving rods are disposed at same positions of eccentric portions on both sides of said shaft of said first driving apparatus, such that said handle support rod and said saddle support rod can perform leaping back-and-forth and up-and-down movements.

5. The oscillated fitness bicycle structure of claim 1, wherein said second driving apparatus has said driving wheel of said second driving apparatus with a diameter smaller than said driving wheel of said first driving apparatus, so that said weight wheel and said driving wheel of said first driving apparatus have a larger ratio of speeds.

* * * * *